US005453755A

United States Patent [19]

Nakano et al.

[11] Patent Number: 5,453,755

[45] Date of Patent: Sep. 26, 1995

[54] CIRCULARLY-POLARIZED-WAVE FLAT ANTENNA

[75] Inventors: Hisamatsu Nakano, Kodaira; Motoshige Sekine, Takasaki; Kazuhiro Yokoyama; Yukio Nakagawa, both of Tomioka; Eiichi Tanaka, Annaka; Shigeru Yoshida, Takasaki; Masaaki Kasama, Maebashi; Itsuo Nakayama, Takasaki; Takao Kawahara, Ayase, all of Japan

[73] Assignee: Kabushiki Kaisha Yokowo, Tokyo, Japan

[21] Appl. No.: 6,518

[22] Filed: Jan. 21, 1993

[30] Foreign Application Priority Data

| | | | |
|---|---|---|---|
| Jan. 23, 1992 | [JP] | Japan | 4-006923 U |
| Jan. 23, 1992 | [JP] | Japan | 4-006924 U |
| Jan. 23, 1992 | [JP] | Japan | 4-006925 U |
| Jan. 23, 1992 | [JP] | Japan | 4-006926 U |
| Jan. 23, 1992 | [JP] | Japan | 4-006927 U |
| Jan. 23, 1992 | [JP] | Japan | 4-006928 U |

[51] Int. Cl.[6] ..... H01Q 21/24

[52] U.S. Cl. ..... 343/872; 343/878; 343/895

[58] Field of Search ..... 343/741, 895, 343/850, 872, 878; H01Q 1/36, 21/24

[56] References Cited

U.S. PATENT DOCUMENTS

| | | | |
|---|---|---|---|
| 3,646,563 | 2/1972 | Francis et al. | 343/895 |

FOREIGN PATENT DOCUMENTS

| | | | |
|---|---|---|---|
| 132945 | 2/1985 | European Pat. Off. . | |
| 348370 | 12/1989 | European Pat. Off. . | |
| 523770 | 1/1993 | European Pat. Off. . | |
| 2347794 | 11/1977 | France | 343/741 |
| 2-189008 | 7/1990 | Japan . | |
| 1234751 | 6/1971 | United Kingdom | 343/895 |
| 2227369 | 7/1990 | United Kingdom . | |

OTHER PUBLICATIONS

"Low–Profile Helical Array Antenna Fed From A Radial Waveguide," H. Nakano, et al., IEEE Transaction on Antennas and Propagation, Mar., No. 3, New York.

*Primary Examiner*—Michael C. Wimer

*Attorney, Agent, or Firm*—Dickstein, Shapiro & Morin

[57] ABSTRACT

A plurality of insulators are disposed in holes, respectively, defined in a metal plate of a waveguide of a circularly-polarized-wave flat antenna. Each insulator has a through-hole and a protrusion. The through-hole extends from the outside of the metal plate to the inside of the waveguide. The protrusion protrudes outward beyond the metal plate. The protrusion has a groove which is open to the outside. Curl antenna elements each have a shaft portion, an arm portion, and a curl portion. The shaft portion is fitted in the through-hole of the insulator and partly protrudes outward from the metal plate. The arm portion extends from the protruded end of the shaft portion. The curl portion is in a substantially helical shape and connected to the top of the arm portion. When the arm portion is engaged with the groove of the insulator, provided that the position of the groove of the insulator has been set in accordance with a desired orientation of the curl portion of the curl antenna element, the orientation of the curl portion is automatically set to a predetermined direction. Thus, the orientation of the curl portion can be precisely set to the predetermined direction. As a result, the operation for mounting a large number of curl antenna elements on the insulators in different directions according to the positions thereof can be easily performed.

17 Claims, 17 Drawing Sheets

CIRCULARLY-POLARIZED-WAVE FLAT ANTENNA

BACKGROUND OF THE INVENTION

1. Field of the Invention

The present invention relates to a circularly-polarized-wave flat antenna having a large number of circularly-polarized-wave antenna elements protruding on the outer surface of a metal plate of a waveguide power distributor.

2. Description of the Related Art

In recent years, a variety of communication systems and broadcasting systems using circularly-polarized microwaves have been proposed. Accordingly, a variety of circularly-polarized-wave antennas for transmitting and receiving circularly polarized microwaves have been studied and developed. One of the circularly-polarized-wave antennas, a circularly-polarized-wave flat antenna using curl antenna elements has been proposed.

More specifically, the circularly-polarized-wave flat antenna has a hollow disc-shaped waveguide constructed of two disc-shaped metal plates equally spaced by a predetermined distance. The waveguide and a power feeding member disposed at the middle of a first metal plate construct a waveguide power distributor. On the outer surface of a second metal plate, a curl antenna array consisting of a large number of curl antenna elements is disposed. Each curl antenna element comprises a shaft portion and a helical curl portion. One end of the shaft portion extends almost vertically from the second metal plate. The other end of the shaft portion is inserted into the waveguide. The other end of the shaft portion is insulated from the waveguide. The curl portion is curled for 1 to 1.5 turns and connected to the protruded end of the shaft portion. The curl antenna element array is separated into a plurality of rows disposed in a ring shape about the center of the second metal plate.

Microwaves are received by the curl portion and the protruded end of the shaft portion of each curl antenna element. The received microwaves are sent to the power feeding member through the inserted portion of the shaft portion and the waveguide. In the case of transmission, signals received from a transmitter are sent to the curl portion and the protruded portion of the shaft portion through the waveguide and the inserted portion of the shaft portion. Thus, circularly polarized microwaves are radiated from the curl portion and the protruded portion of each curl antenna element.

With respect to the circularly-polarized-wave flat antenna, the phases of circularly polarized waves radiated from all the curl antenna elements should match each other. Thus, the orientation of the curl portion of each curl antenna element, that is, the direction about the shaft portion of the curl antenna element, depends on its position disposed on the metal plate. Therefore, the curl portion of each curl antenna element should be oriented in a predetermined direction.

As a result, it is desired to simplify the operation for mounting a large number of curl antenna elements on the metal plate in different directions according to predetermined positions.

SUMMARY OF THE INVENTION

An object of the present invention is to provide a circularly-polarized-wave flat antenna where the orientation of the curl portion of each curl antenna element, that is, the direction about the shaft portion of the curl antenna element, can be precisely set in a predetermined direction and the operation for mounting a large number of curl antenna elements in different directions according to predetermined positions is facilitated.

The circularly-polarized-wave flat antenna according to the present invention comprises a waveguide having a metal plate, the metal plate having a plurality of holes, at least one insulator, the insulator being mounted in a hole of the metal plate and having a through-hole and a protrusion, the through-hole extending from the outside of the metal plate to the inside of the waveguide, the protrusion protruding to the outside of the metal plate and having a groove which is open to the outside, and at least one circular wave antenna element having a shaft portion, an arm portion, and a curl portion, the shaft portion being fitted in the through-hole of the insulator and having a top thereof protruding outward beyond the metal plate, the arm portion protruding from the top of the shaft portion to terminate at an end, the curl portion being in a substantially helical shape and connected to the end of the arm portion, the arm portion being engaged with the groove of the insulator, whereby if the position of the groove has been set in accordance with a desired orientation of the curl portion of the circularly polarized wave antenna element, the engagement of the arm portion with the groove will automatically set the orientation of the curl portion in a predetermined direction.

According to the present invention, the groove which is open to the outside is formed on the protruded portion of the insulator. Provided that the position of the groove has been set to a desired orientation of the curl portion of each curl antenna element about the shaft portion, the orientation of the curl portion can be automatically set to a predetermined direction when the arm portion of the curl antenna element is engaged with the groove of the arm portion. Thus, the orientation of the curl portion can be precisely set to a predetermined direction. As a result, the operation for mounting a large number of curl antenna elements in desired different directions according to predetermined positions can be easily performed.

These and other objects, features and advantages of the present invention will become more apparent in light of the following detailed description of best mode embodiments thereof, as illustrated in the accompanying drawings.

DESCRIPTION OF THE PREFERRED EMBODIMENTS

First, with reference to FIGS. 1 and 2, a curl antenna element will be described. As shown in FIGS. 1A, 1B, and 2A, the curl antenna element 2 comprises a curl portion 2*a* and a shaft portion 2*b*. The curl portion 2*a* is curled circumferentially from a point S to a point e (see FIGS. 1A and 2A). The shaft portion 2*b* has a line segment fq and a line segment qs. The line segment fq will be referred to as an upstanding portion of the shaft portion 2*b*, while the line segment qs will be referred to as a branch or arm portion of the shaft portion 2*b*. A point f of the shaft portion 2*b* will be referred to as a rear terminal. The portion adjacent to the point f will be referred to as a rear terminal portion.

Figure 1A:
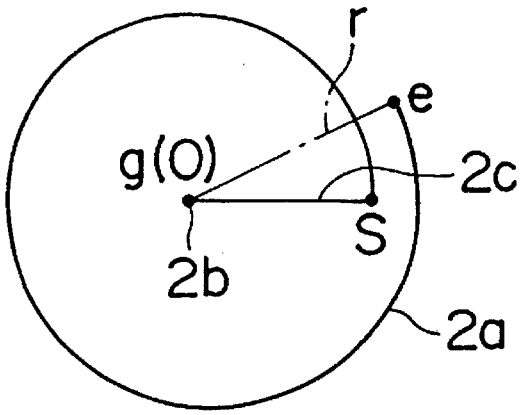
FIG. 1A is a plan view showing a curl antenna element.
Figure 2D:
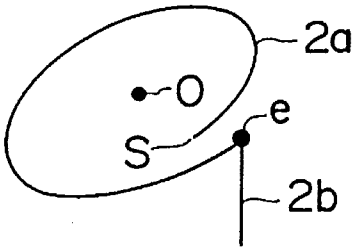
FIG. 2D is a perspective view showing a further modification of the curl antenna element.
Figure 2C:
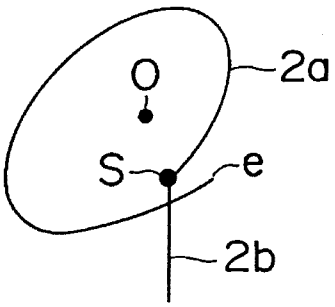
FIG. 2C is a perspective view showing another modification of the curl antenna element.
Figure 2B:
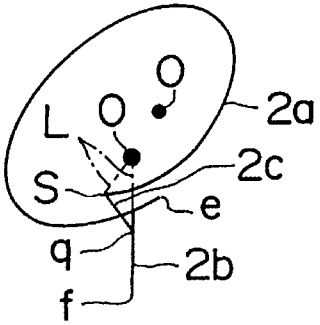
FIG. 2B is a perspective view showing a modifications of the curl antenna element.
Figure 2A:
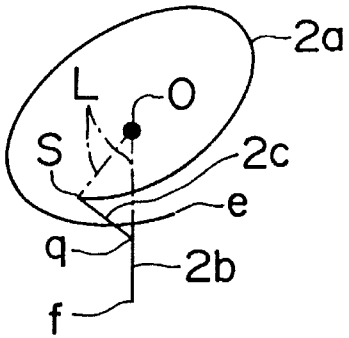
FIG. 2A is a perspective view showing the curl antenna element.

As shown in FIGS. 1A and 2A, the curl portion 2*a* is made of a wire material and formed in a curl shape. The curl shape means a helical shape, where semi-circles with different diameters are connected, or a similar helical shape. More specifically, in the case where the center of a helix is O, the start point thereof is S, the end point thereof is e, and the distance between the center O and the end point e of the helix is r, the outer circumference C ($2\pi r$) should satisfy the following relation.

$$(3/4)\lambda < C < (3/2)\lambda$$

where $\lambda$ is the propagation wavelength of the antenna. The number of turns of the curl is in the range from 1 to 1.5. Thus, the length of the curl portion 2*a* is a half or less than that of a conventional helical antenna (which normally has five or more turns of curl).

Figure 1B:
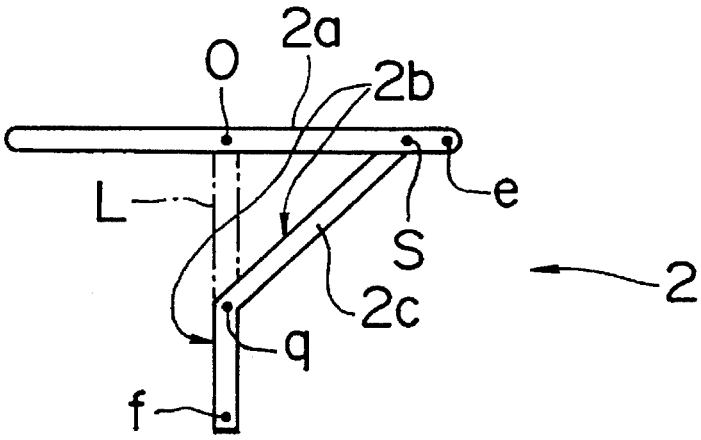
FIG. 1B is a side view of the curl antenna element of FIG. 1A.

As shown in FIGS. 1A, 1B, and 2A, the shaft portion 2*b* is made of a wire material. The upstanding portion extends vertically, whereas the branch portion 2*c* extends to the start point S of the curl portion 2*a* with an angle to the upstanding portion. When a current flows in the shaft portion 2*b* (which has the upstanding portion and the branch portion 2*c*) and the curl portion 2*a*, power radiated from the curl portion 2*a* is superimposed to power radiated from the shaft portion 2*b*, thereby forming a desired radiation beam.

The curl antenna element 2 may be constructed as shown in FIGS. 2B, 2C, and 2D. More specifically, as shown in FIG. 2B, the branch portion 2*c* may be shorter than that shown in FIGS. 1A, 1B, and 2A. In FIG. 2B, the point O of FIGS. 1A, 1B, and 2A is inwardly shifted to point O'. As shown in FIG. 2C, the shaft portion 2*b* may be constructed of only an upstanding portion. Thus, the upstanding portion 2*b* is connected directly to the start point S of the curl portion 2*a*. In addition, as shown in FIG. 2D, the upstanding portion 2*b* may be connected directly to the end point e of the curl portion 2*a*. Moreover, the curl portion 2*a* and the shaft portion 2*b* can be integrally formed. Furthermore, after the curl portion 2*a* and the shaft portion 2*b* are separately formed, they may be soldered or welded. In FIGS. 1A, 1B, and 2A, the branch portion 2*c* is connected to the start point S of the curl portion 2*a*. Rather, the branch portion 2*c* may be connected to the end point e of the curl portion 2*a*. In addition, as shown by an imaginary line L in FIGS. 2A and 2B, the upstanding portion may vertically extend to the point O (or point O'), whereas the branch portion 2*c* may extend horizontally.

Figure 3A:
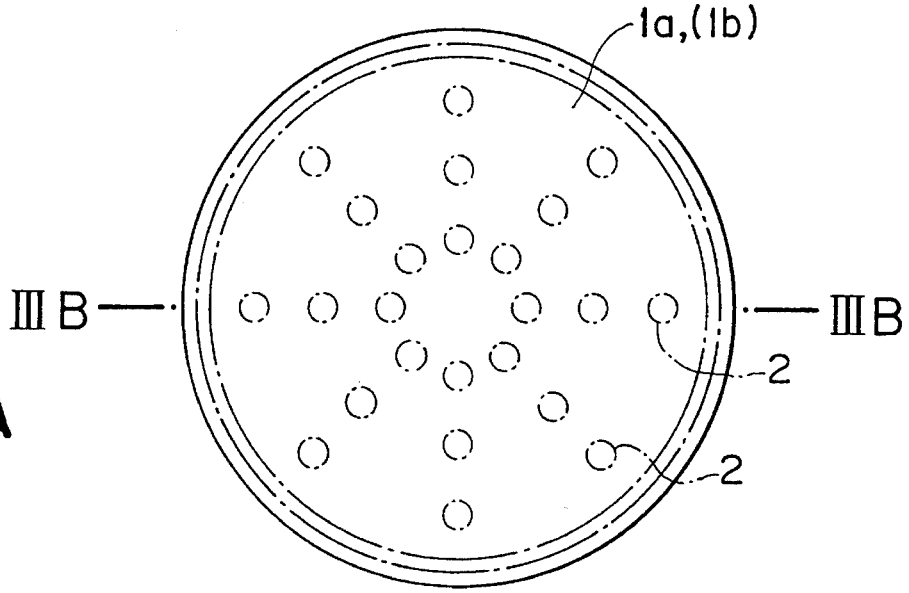
FIG. 3A is a plan view showing a circularly-polarized-wave flat antenna having curl antenna elements mounted on a waveguide power distributor.

Next, with reference to FIGS. 3A and 3B, a circularly-polarized-wave flat antenna having curl antenna elements will be described.

The circularly-polarized-wave flat antenna comprises a waveguide power distributor 1 and at least one curl antenna element 2. The power is fed to the curl antenna element 2 from the waveguide power distributor 1. This construction is referred to as a waveguide-power-feeding construction. The waveguide power distributor 1 comprises a pair of an upper metal plate 1*a* and a lower metal plate 1*b* which are opposed to each other. The upper metal plate 1*a* has at least one through-hole 1*f*. Between the metal plates 1*a* and 1*b*, a power propagation space 1*c* is formed. The distance between the metal plates 1*a* and 1*b* is smaller than the wavelengths of microwaves being transmitted and received. A shortcircuit metal ring 1*d* is disposed between the outer circumference of the metal plate 1*a* and that of the metal plate 1*b*. It should be noted that the shape of the metal plates 1*a* and 1*b* is not limited to a circle shown in the figure. The shape of the metal plates 1*a* and 1*b* may be a polygon.

Figure 3B:
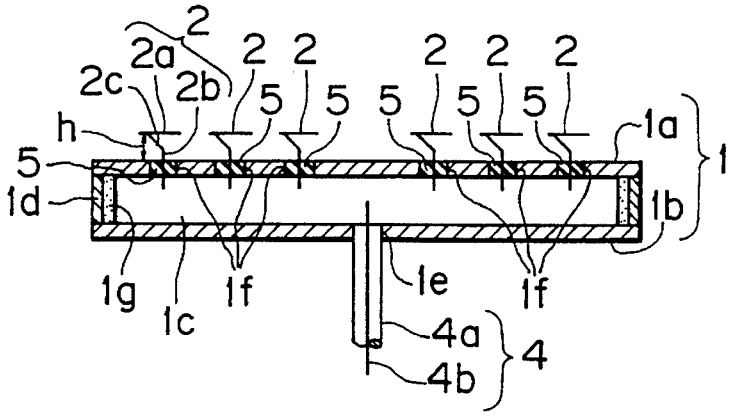
FIG. 3B is a sectional view taken along line IIIB—IIIB of FIG. 3A.

As shown in FIG. 3B, a center hole 1*e* is formed at the center of the lower metal plate 1*b*. At the center hole 1*e*, a coaxial feeder 4 is mounted. An outer conductor 4*a* of the coaxial feeder 4 is connected to the metal plate 1*b*. An inner conductor 4*b* of the coaxial feeder 4 is inserted into the power propagation space 1*c*. When necessary, a radio wave absorber 1*g* for absorbing a residual power may be disposed inside the metal ring 1*d*.

The curl antenna elements 2 are disposed in accordance with the through-holes 1*f* on the upper metal plate 1*a*. In other words, each through-holes 1*f* holds an insulator 5. The shaft portion 2*b* of each curl antenna element 2 is rotatably supported by the insulator 5. The lower end portion of the shaft portion 2*b* protrudes from the insulator 5 to the inside of the power propagation space 1*c*. On the other hand, the upper end portion of the shaft portion 2*b* protrudes upwardly from the upper metal plate 1*a* so that power radiated from the shaft portion 2*b* is superimposed to that from the curl portion 2*a*.

The distance h from the connection point between the curl portion 2*a* and the shaft portion 2*b* to the upper metal plate 1*a* is limited to approximately (¼)λ or less (where λ is the propagation wavelength of the antenna).

Since the circularly-polarized-wave flat antenna is constructed as described above, power is fed from the coaxial feeder 4 to each curl antenna element 2 through the waveguide power distributor 1. In other words, the power in the waveguide power distributor 1 is sent to the lower end portion of the shaft portion 2*b*. The power radiated from the protruded upstanding portion 2*b* and the branch portion 2*c* above the metal plate 1*a* is superimposed to the power radiated from the curl portion 2*a*. Thus, a radiation beam is formed. At this point, since a large number of curl antenna elements 2 are adjacently disposed, because of the array effect, a sharp radiation beam can be formed. Thus, the gain of the antenna can be improved. Moreover, by rotating the curl portion 2*a* about the upstanding portion of the shaft portion 2*b*, the phase of the radiation field can be adjusted.

Figure 4A:
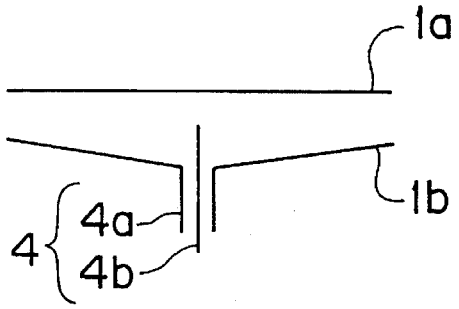
FIG. 4A is a schematic diagram showing a modification of the waveguide power distributor.
Figure 4B:
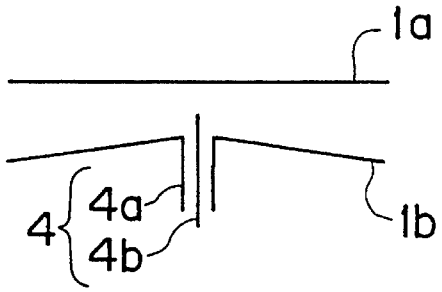
FIG. 4B is a schematic diagram showing another modification of the waveguide power distributor.
Figure 4C:
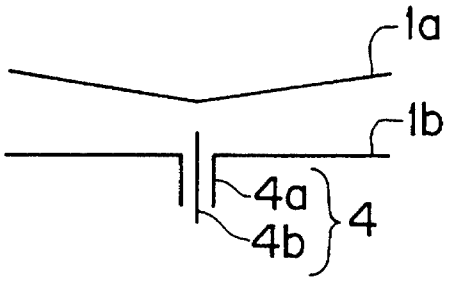
FIG. 4C is a schematic diagram showing a further modification of the waveguide power distributor.
Figure 4D:
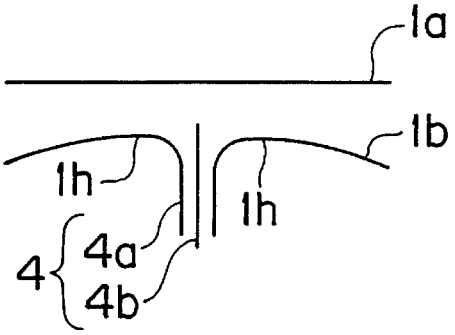
FIG. 4D is a schematic diagram showing a still further modification of the waveguide power distributor.

It should be appreciated that the metal plates 1*a* and 1*b* may be constructed as shown in FIGS. 4A, 4B, 4C, and 4D. More specifically, as shown in FIG. 4A, the lower metal plate 1*b* may be formed in a cone shape where the center thereof dents. In addition, as shown in FIG. 4B, the lower metal plate 1*b* may be formed in a reverse cone shape where the center thereof protrudes upwardly. Moreover, as shown in FIG. 4C, the upper metal plate 1*a* may be formed in a cone shape where the center thereof dents. Furthermore, the lower metal plate 1*b* (not shown) may be formed in a reverse cone shape where the center thereof protrudes upwardly. The protruded surface may be in a curved surface shape. The upper metal plate 1*a* and the lower metal plate 1*b* may be formed in a shape of a combination of a plane and a curved surface. FIG. 4D shows an example of the lower metal plate 1*b* which is in a curved surface shape.

Next, with reference to FIGS. 5 to 9, a circularly-polarized-wave flat antenna in accordance with a first embodiment of the present invention will be described.

Figure 9:
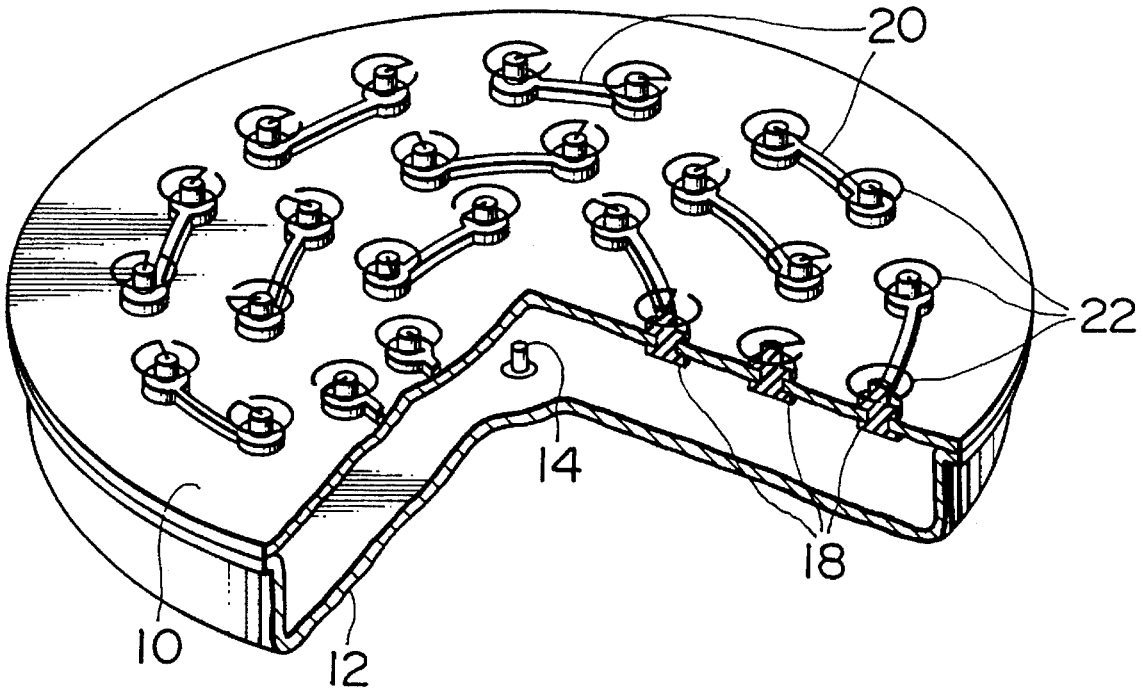
FIG. 9 is a partially exploded perspective view of a circularly-polarized-wave flat antenna in accordance with a first embodiment of the present invention.

As shown in FIG. 9, a hollow disc-shaped waveguide power distributor is constructed of two metal plates 10 and 12 opposed to and equally spaced from each other. At the center of the lower metal plate 12, a power feeding member 14 is disposed. On the upper metal plate 10, a large number of holes are formed.

Figure 5:
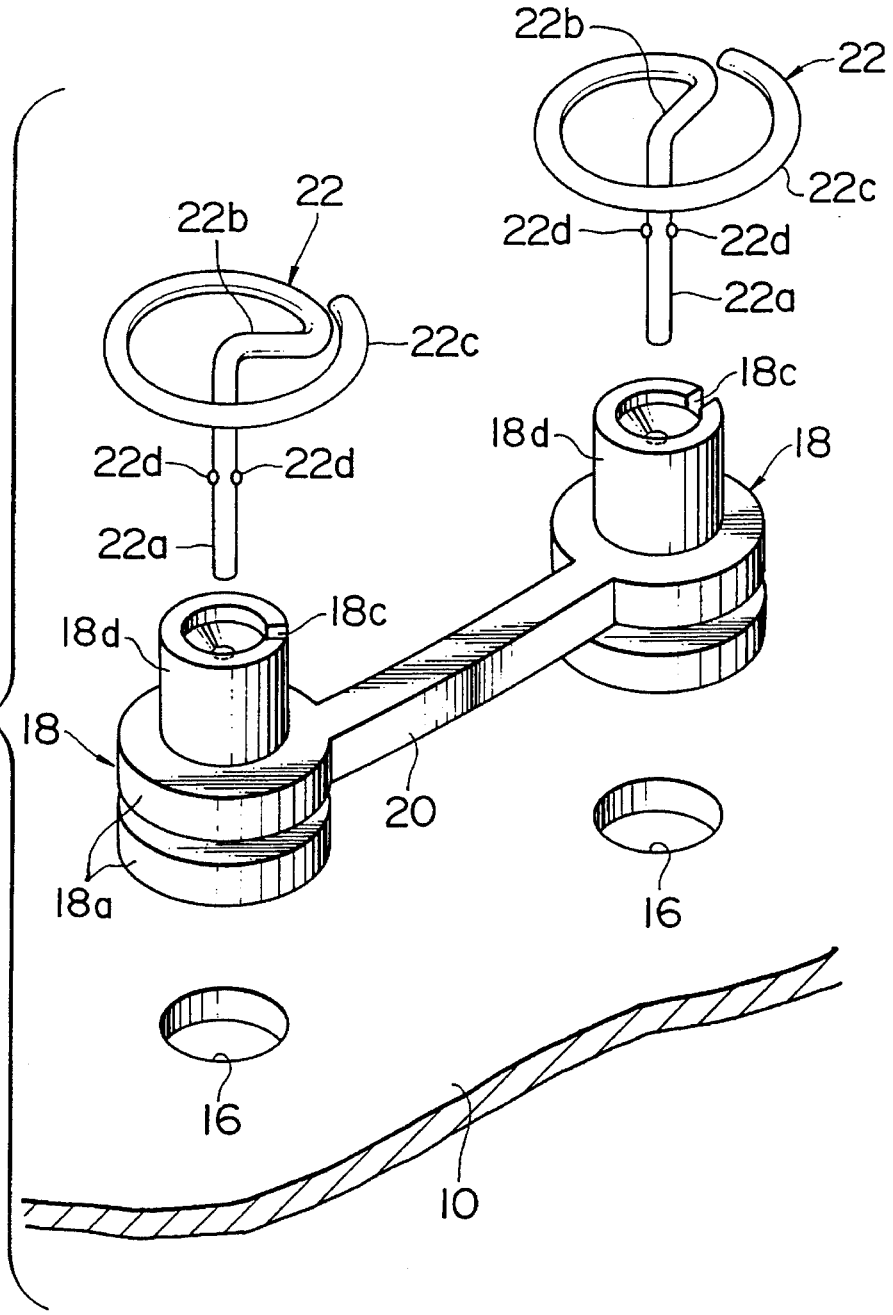
FIG. 5 is an exploded perspective view of a curl antenna element and an insulator in accordance with a first embodiment of the present invention.
Figure 6:
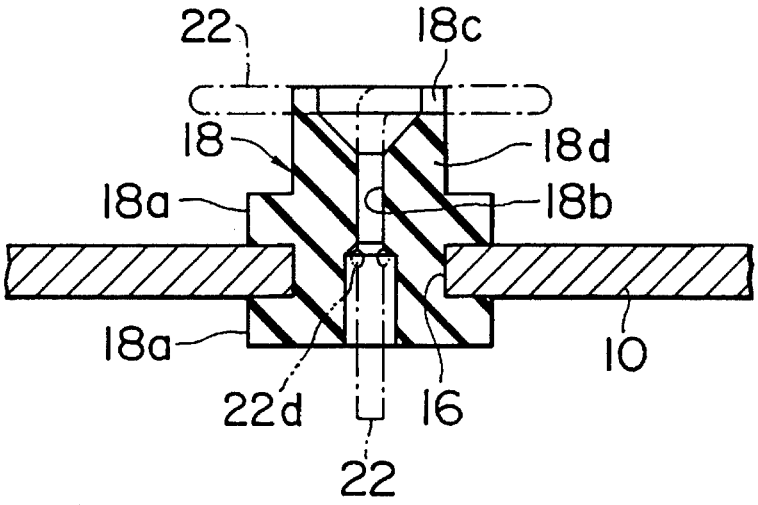
FIG. 6 is a sectional view of the insulator and so forth of FIG. 5.
Figure 7:
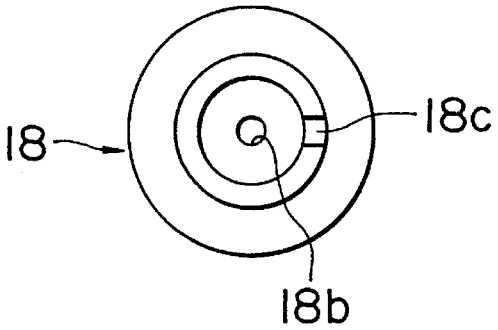
FIG. 7 is a plan view of the insulator and so forth of FIG. 5.
Figure 8:
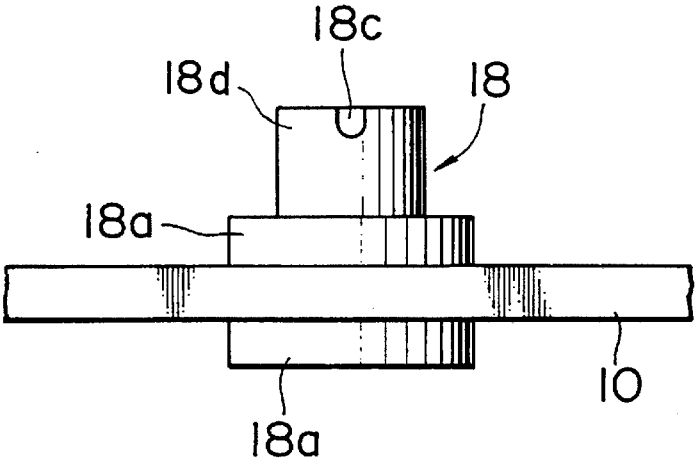
FIG. 8 is a side view of the insulator and so forth of FIG. 5.

In the respective holes 16 of the metal plate 10, a large number of insulators 18 which are made of an insulating resin are formed by an outsert forming process. As shown in FIG. 6, each insulator 18 has two enlarged-diameter portions 18*a* formed on both the surfaces of the metal plate 10. The enlarged-diameter portions 18*a* prevent the insulator 18 from being detached from the metal plate 10. In addition, each insulator 18 has a shaft insertion hole 18*b* extending in the vertical direction of the metal plate 10. A lower portion of the shaft insertion hole 18*b* has a greater diameter than the other portion thereof. In addition, at the top of the insulator 18 is formed a protrusion 18*d* in the form of an upwardly protruding cylinder, and a groove 18*c* which is open to the outside is provided at the top of the protrusion 18*d*. The groove 18*c* extends in a substantially radial direction of the protrusion. The mold for use in the outsert forming process is constructed so that each groove 18*c* is oriented in a predetermined direction according to the position of an antenna element disposed. Moreover, a connection member 20 for connecting two adjacent insulators 18 is integrally formed therewith, as shown in FIGS. 5 and 9.

As described above, each curl antenna element 22 mounted to the insulator 18 comprises a shaft portion 22*a*, a branch or arm portion 22*b*, and a curl portion 22*c*. In the example of FIG. 5, the arm portion 22*b* is disposed nearly in parallel with the metal plate 10. In addition, at the middle of the shaft portion 22*a*, bumps 22*d* are disposed. The bumps 22*d* are formed by flattening parts of the shaft portion 22*a*. When assembled, the shaft portion 22*a* is inserted into the shaft insertion hole 18*b* of the insulator 18. In addition, the branch or arm portion 22*b* is engaged with the groove 18*c*. Thus, as shown in FIG. 6, the bumps 22*d* are positioned at the enlarged-diameter portions of the shaft insertion hole 18*b*, thereby preventing the curl antenna element 22 from slipping outward. Moreover, provided that the position of the groove 18*c* has been set in accordance with the orientation of the curl portion 22*c*, when the arm portion 22*b* is engaged with the groove 18*c*, the orientation of the curl portion 22*c* is automatically set to a predetermined direction.

As described above, since the two insulators 18 are connected by the connection member 20, they are not rotated about the hole 16. The position of the groove 18*c* has been set in accordance with the orientation of the curl portion 22*c* disposed. Thus, when the arm portion 22*b* is engaged with the groove 18*c*, the direction of the curl portion 22*c* is automatically set to the predetermined direction.

Since the two insulators 18 are connected by the connection member 20, they are not rotated about the hole 16. Thus, since the hole 16 may be formed in a perfect circular shape, and therefore the shape of the mold for forming holes can be simplified. Thus, a large number of holes 16 can be easily formed on the metal plate 10.

It should be noted that the number of insulators 18 connected together by the connection member 20 can be three or more. In addition, rather than using the connection member 20, the holes 16 formed on the metal plate 10 may be in a non-circular shape, for example, a square shape, an elliptic shape, or a gourd shape in cross section, thereby preventing the insulators from rotating. At this point, the insulators 18 may be formed by the outsert forming process. In addition, the insulators 18 may be formed by another forming process.

Furthermore, after the insulators 18 are formed by the insert forming process or the like rather than the outsert forming process, they can be mounted in the holes 16 of the metal plate 10. In this case, the insulators 18 can be formed in a non-circular shape such as a gourd shape in cross section and each hole 16 may be formed in the corresponding shape thereof so that they are not rotated. At this point, each hole 16 should be formed so that the groove 18 is oriented in the predetermined direction in accordance with the position of each curl antenna element 22.

Thus, in inserting the curl antenna element 22 into the insulator 18, when the arm portion 22*b* is engaged with the groove 18*c*, the curl portion 22*c* of the curl antenna element 22 is oriented in the predetermined direction in accordance with the position of the curl antenna element 22. Thus, the orientation of the curl portion 22*c* can be precisely set and the operation for mounting a large number of curl antenna elements 22 on insulators in different directions in accordance with the positions thereof can be easily performed.

In addition, when at least two insulators 18 are connected by a connection member, they are not rotated about their axes of the holes 16. Thus, the holes formed on the metal plate can be in a perfect circular shape, and therefore the shape of the mold or the like for forming them can be simplified whereby the cost becomes cheap. As a result, the circularly-polarized-wave flat antenna can be produced at a low cost. Moreover, when the insulators 18 have been formed on the metal plate by the outsert forming process, the groove 18*c* of each insulator 18 may be precisely formed by a forming mold so that the orientation of the groove 18*c* is set in accordance with the position of each curl antenna element 22. Thus, in comparison with the case where the insulators are independently formed and mounted on the metal plate, the number of assembling steps can be decreased, so that this antenna is suitable for mass-production.

Next, with reference to FIGS. 10 to 12, a circularly-polarized-wave flat antenna in accordance with a second embodiment of the present invention will be described.

Figure 10:
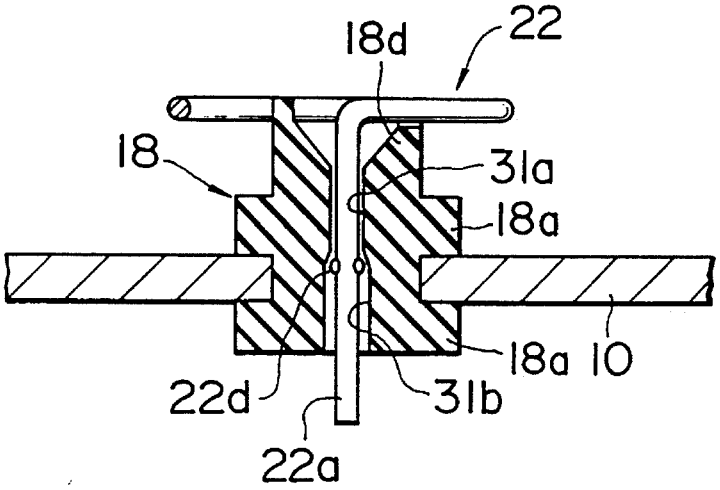
FIG. 10 is a sectional view of a curl antenna element, an insulator, and so forth in accordance with a second embodiment of the present invention.
Figure 11:
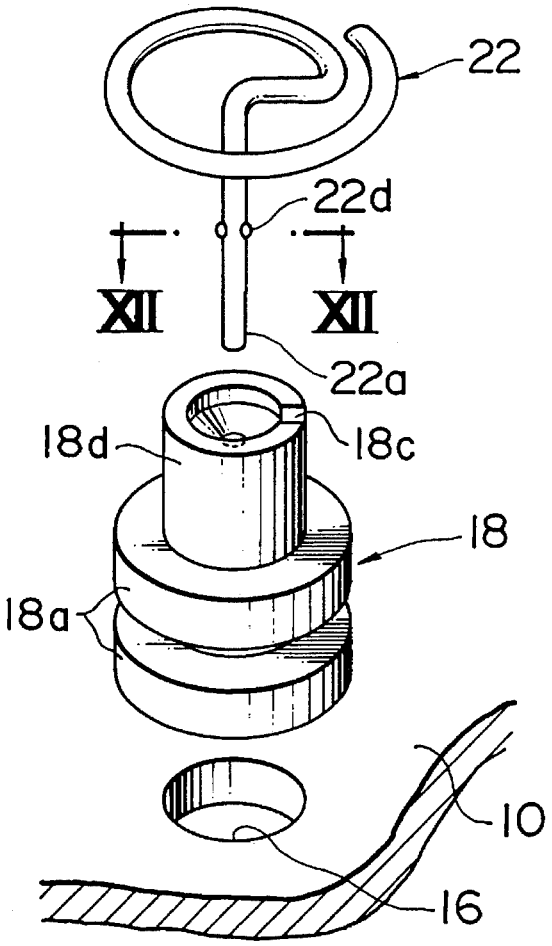
FIG. 11 is an exploded perspective view of the curl antenna element, the insulator, and so forth of FIG. 10.

As shown in FIG. 10, an insulator 18 has a through-hole 31 in which a shaft portion 22*a* of a curl antenna element 22 is inserted. The through-hole 31 has a reduced-diameter portion 31*a* and an enlarged-diameter portion 31*b*. The reduced-diameter portion 31*a* is formed in the upper side of the insulator 18, while the enlarged-diameter portion 31*b* is formed in the lower side of the insulator 18. At the middle of the shaft portion 2*a* of the curl antenna element 22, a pair of lugs or bumps 22*d* are provided. The bumps 22*d* are formed by flattening parts of the shaft portion 22*a*.

Figure 12:
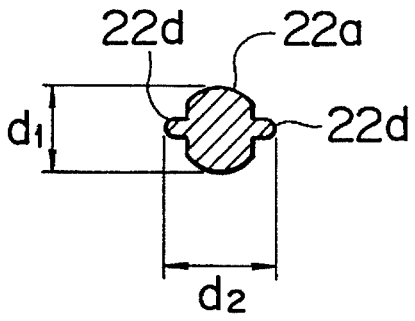
FIG. 12 is a sectional view taken along line XII—XII of FIG. 11.

As shown in FIG. 12, the inner diameter of the reduced-diameter portion 31*a* of the through-hole 31 is larger than the outer diameter d1 of the shaft portion 22*a* and is smaller than the outer diameter d2 of the shaft portion 22*a* and the bumps 22*d*. In other words, the inner diameter of the reduced-diameter portion 31*a* is larger than the outer diameter d1. When the shaft portion is inserted into the through-hole, the through-hole is resiliently deformed so as to allow the bumps to pass therethrough.

Thus, when the shaft portion 22*a* of the curl antenna element 22 is inserted into the through-hole 31 of the insulator 18, the reduced-diameter portion 31 is elastically deformed and thereby widened so that the bumps 22*d* can be inserted thereinto. When the bumps 22*d* come to the enlarged-diameter portion 31*b*, the force necessary for the insertion thereof immediately decreases. Thus, the worker can know that the shaft portion 22*a* has been completely inserted into the through-hole 31 for a predetermined length. To remove the shaft portion 22*a* from the through-hole 31, the reduced-diameter portion 31*b* should be resiliently deformed and thereby widened by the bumps 22*d*. Therefore, the curl antenna element 22 which is relatively light in weight does not slip out by vibration or the like. In addition, since the required work for assembling the curl antenna element 2 is only to insert the shaft portion 22*a* into the through-hole 31, it can be easily performed.

Figure 13:
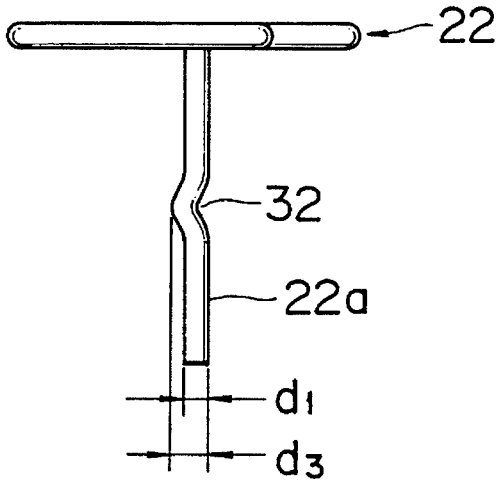
FIG. 13 is a side view of a first modification of the curl antenna element in accordance with the second embodiment.

FIG. 13 shows a modification of the second embodiment. A shaft portion 22*a* of a circular-polarized-wave antenna element 22 has a bent portion 32 formed at the middle thereof. The bent portion 32 may be in for example an arc shape or a non-straight line shape. The outer diameter d3 of the shaft portion 22*a* and the bent portion 32 is larger than a reduced-diameter portion 31*a* and smaller than an enlarged-diameter portion 31*b*.

Thus, according to this modification, when the shaft portion 22*a* is inserted into a through-hole 31, the reduced-diameter portion 31*a* is resiliently deformed and thereby widened by the shaft portion 22*a* so that the bumps 22*d* can be inserted thereinto. Thus, the antenna element 22 can be prevented from slipping out from the through-hole 31 and easily assembled.

Figure 14:
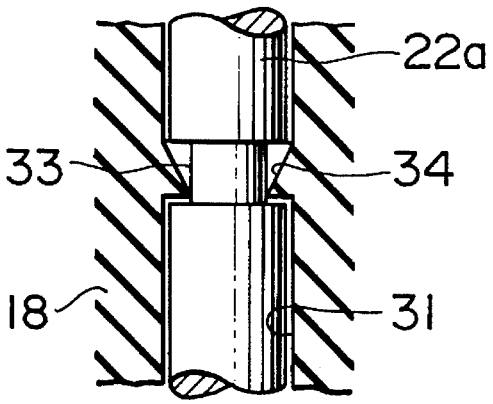
FIG. 14 is a sectional view showing a shaft portion and an insulator of a second modification of the curl antenna element in accordance with the second embodiment.

FIG. 14 shows a second modification of the second embodiment. At the middle of a shaft portion 22*a*, a groove 33 is circumferentially formed. At a predetermined position of a through-hole 31, a radially inward protrusion which is engaged with the groove 33 is circumferentially formed. The inner diameter of the inward protrusion 34 is smaller than the outer diameter of the shaft portion 22*a* and larger than the diameter of the bottom of the groove 33. The inward protrusion 34 has for example a taper and a step on the side where the shaft portion 22*a* is inserted and on the side where the shaft portion 22*a* is removed, respectively.

Thus, according to the second modification of the second embodiment, when the shaft portion 22*a* is inserted into the through-hole 31, the inward protrusion 34 is resiliently deformed and thereby widened so that the shaft portion 22*a* can be inserted thereinto. When the shaft portion 22*a* is inserted by the predetermined length, the inward protrusion 34 is engaged with the groove 33. Thus, the shaft portion 22*a* is prevented from slipping out from the through-hole 31. In addition, the antenna element 22 can be easily assembled.

Figure 16:
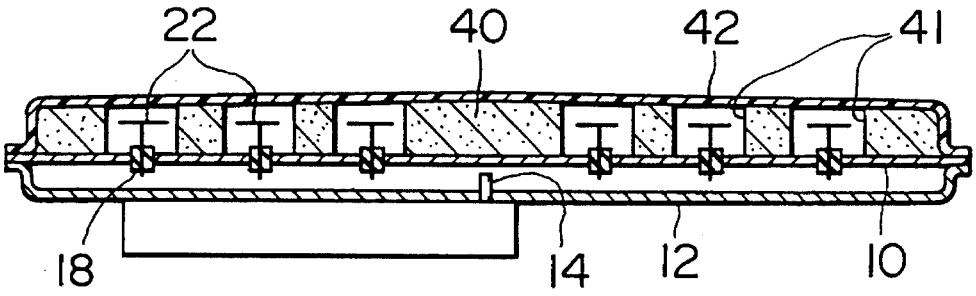
FIG. 16 is a sectional view showing the circularly-polarized-wave flat antenna of FIG. 15.
Figure 17:
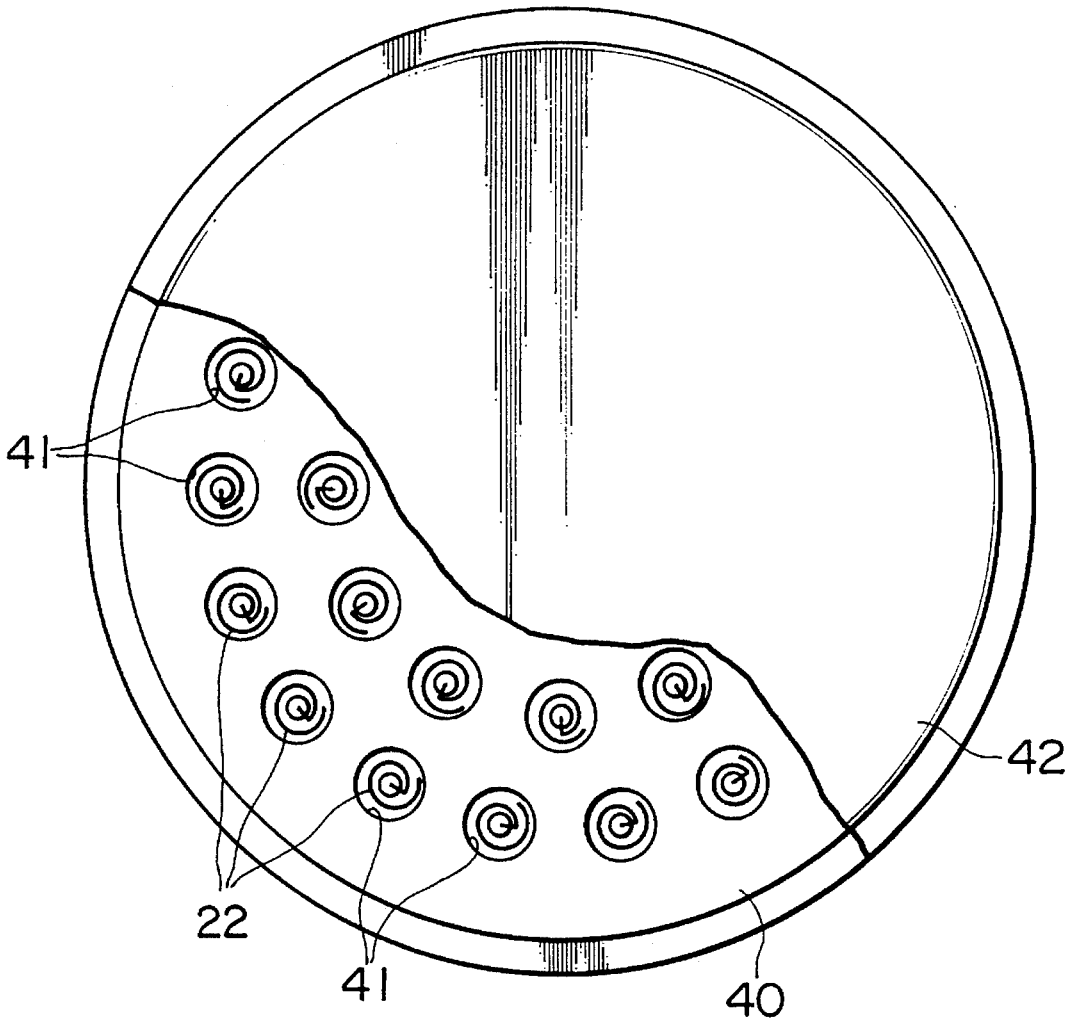
FIG. 17 is a partially exploded plan view of the circularly-polarized-wave flat antenna of FIG. 15.

Next, with reference to FIGS. 15 to 17, a circularly-polarized-wave flat antenna in accordance with a third embodiment of the present invention will be described.

Figure 15:
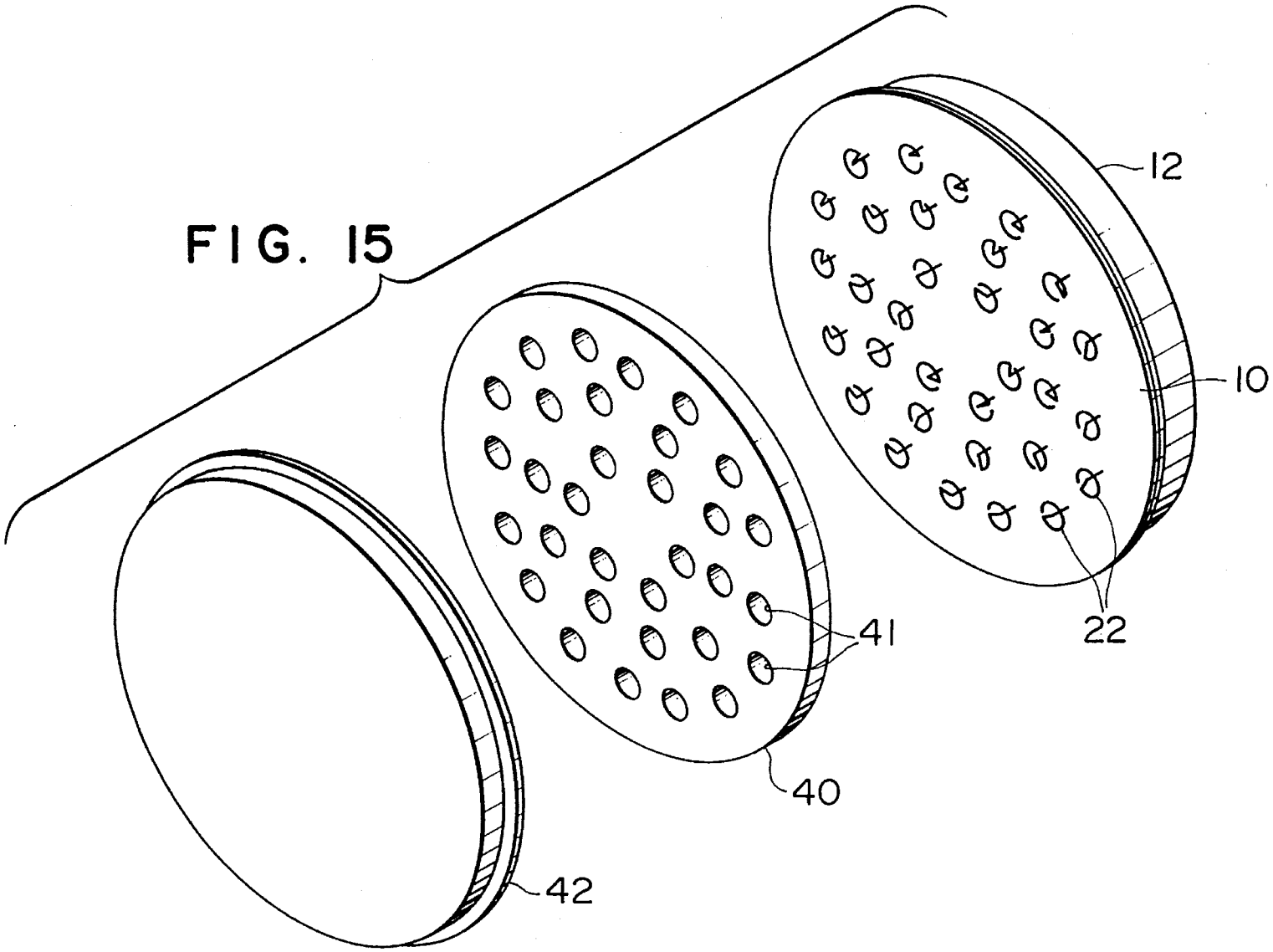
FIG. 15 is an exploded perspective view showing a circularly-polarized-wave flat antenna in accordance with a third embodiment of the present invention.

As shown in FIG. 15, outside the metal plate 10, a radome 42 is disposed. The radome 42 is used to protect a circularly-polarized-wave flat antenna installed outdoors from being exposed to rain and snow, and from being attacked by birds and so forth. The radome 42 is made of a dielectric material. The radome 42 should be designed neither to increase the reflection loss and transmission loss of the circularly-polarized-wave flat antenna, nor to affect the directivity of the antenna. Thus, the radome 42 is thinly formed. In addition, to prevent curl antenna elements 22 from being damaged by strong wind pressure and outer substances, the radome 42 must have a rigidity of a predetermined level.

According to this embodiment, on the outer surface of the metal plate 10, a protection plate 40 is disposed. The protection plate 40 is made of insulating STYROFOAM, a polystyrene plastic. On the outer surface of the protection plate 40, the radome 42 is disposed. The radome 42 is made of polypropylene or the like in a thin plate shape. The protection plate 40 has through-holes 41 for holding the curl antenna elements 22. The height of the protection plate 40 is larger than that of the curl antenna elements 22.

The specific inductive capacity of the protection plate 40 and that of the radome 42 are low. The thickness of the radome 42 is relatively small. Thus, the reflection loss and transmission loss are very low. In addition, since a force applied to the radome 42 is supported by a large surface of the protection plate 40, the radome 42 can be prevented from being deformed by forces applied thereto. Thus, since the curl antenna elements 22 are not deformed, the performance of the antenna is not deteriorated.

Moreover, since forces applied to the radome 42 are supported by the large surface of the protection plate 40, the radome 42 can be formed of a deformable resin such as polypropylene. Thus, as opposed to a conventional radome made of a hard resin, the radome 42 has a resistance to damages such as cracks. Furthermore, since the protection plate 40 can be formed of STYROFOAM, the weight thereof is very light. As a result, without a remarkable weight change, the circularly-polarized-wave flat antenna can be improved. When the circularly-polarized-wave flat antenna is fixed to a pole or the like, because of its light weight, the antenna can be easily fixed.

Figure 18:
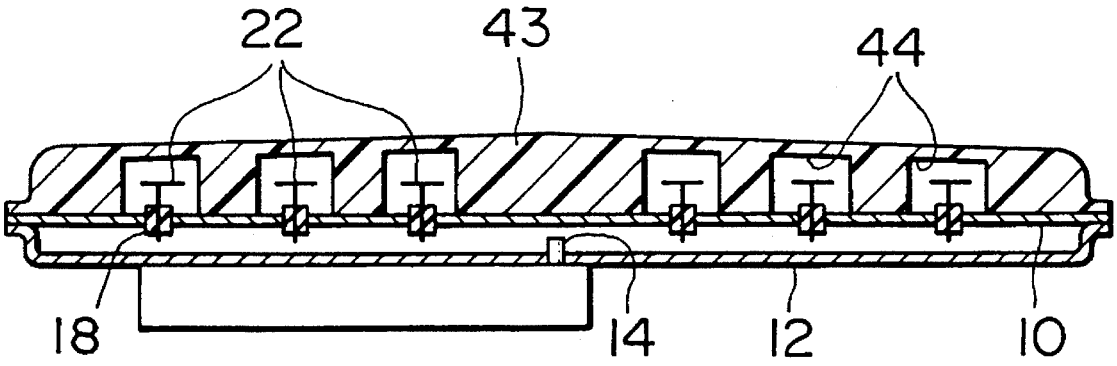
FIG. 18 is a sectional view of a modification of the circularly-polarized-wave flat antenna in accordance with the third embodiment.

FIG. 18 shows a modification of the third embodiment. In this modification, a protection plate is not provided. Instead, a radome 43 is relatively thickly formed. In addition, bottomed-holes 44 for holding curl antenna elements 22 are provided. The inner diameter of the bottomed-hole 44 is larger than the outer diameter of the curl antenna element 22. The depth of the bottomed-hole 44 is larger than the height of the curl antenna element 22. Thus, the bottomed-hole 44 can encase the curl antenna element 22. The bottom of the bottomed-hole 44 is relatively thinly formed so as to decrease the transmission loss of the curl antenna element 22.

As described above, the thin bottom of the bottomed-hole 44 operates as a conventional radome, while the other portion operates as a protection plate for protecting the radome from being deformed. Thus, the radome 43 also operates as the protection plate, so that the number of constructional parts of the circularly-polarized-wave flat antenna according to this modification is small. Thus, this antenna can be easily produced and suitable for mass-production.

Although the protection plate 20 in accordance with the above embodiment is formed of STYROFOAM, the material thereof is not limited thereto. The protection material 20 may be formed of any insulating material with a small specific inductive capacity and which does not affect radiation from the circularly-polarized-antenna elements 22. On the other hand, the material of the radomes 42 and 43 is not limited to polypropylene. Rather, they may be formed of any material with a low transmission loss and a low reflection loss.

As described above, since an external force applied to the radome can be supported by the large surface of the protection plate, the radome itself does not require a large rigidity. Thus, the radome can be thinly formed so as to decrease the transmission loss of the antenna elements. In addition, since the radome does not require a large rigidity, it can be formed of a deformable material, thereby preventing it from being damaged by cracking or the like.

Moreover, when the protection plate is formed of STYROFOAM whose specific inductive capacity is low, it does not affect radiation from the circularly-polarized-wave antenna elements at all. In addition, since the weight of the protection plate is very light, without a remarkable weight change, the circularly-polarized-wave flat antenna can be improved. When the circularly-polarized-wave antenna is fixed to a pole or the like, because of its light weight, the antenna can be easily fixed.

Furthermore, since the radome also operates as the protection plate, the circularly-polarized-wave flat antenna in accordance with this modification can be easily assembled because of a small number of constructional parts thereof. Thus, this antenna is suitable for mass-production.

Next, with reference to FIGS. 19 and 20, a circularly-polarized-wave flat antenna in accordance with a fourth embodiment of the present invention will be described.

With respect to a circularly-polarized-wave flat antenna, a large number of curl antenna elements should be disposed on a metal plate of a waveguide so as to obtain a predetermined antenna gain. Thus, the more the number of curl antenna elements increases, the more must the metal plate be enlarged. As a result, the metal plate tends to be deformed by outer forces or the like. In addition, the inside of the waveguide is airtight. Thus, a large temperature drop may cause the air pressure in the waveguide to become lower than the atmospheric pressure. As a result, a force which deforms the metal plate inwardly may work. When the metal plate is inwardly deformed and thereby the distance g between the two metal plates of the waveguide becomes short, the frequency band of signals which can be transmitted varies and the characteristics of the waveguide as the waveguide power distributor may fluctuate.

Figure 19:
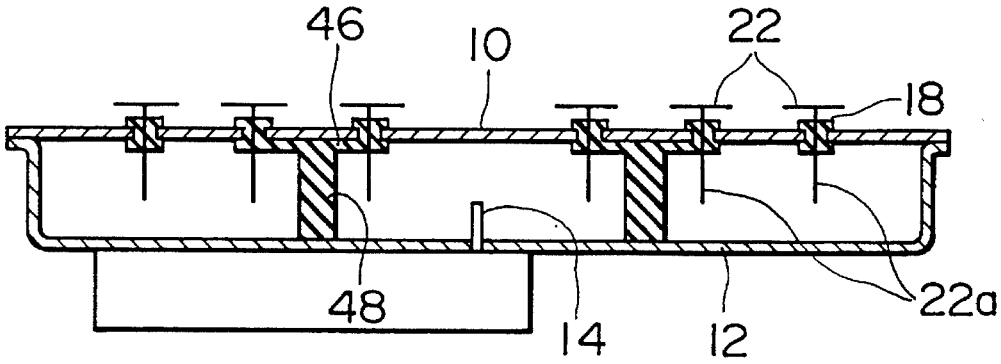
FIG. 19 is a sectional view showing a circularly-polarized-wave flat antenna in accordance with a fourth embodiment of the present invention.
Figure 20:
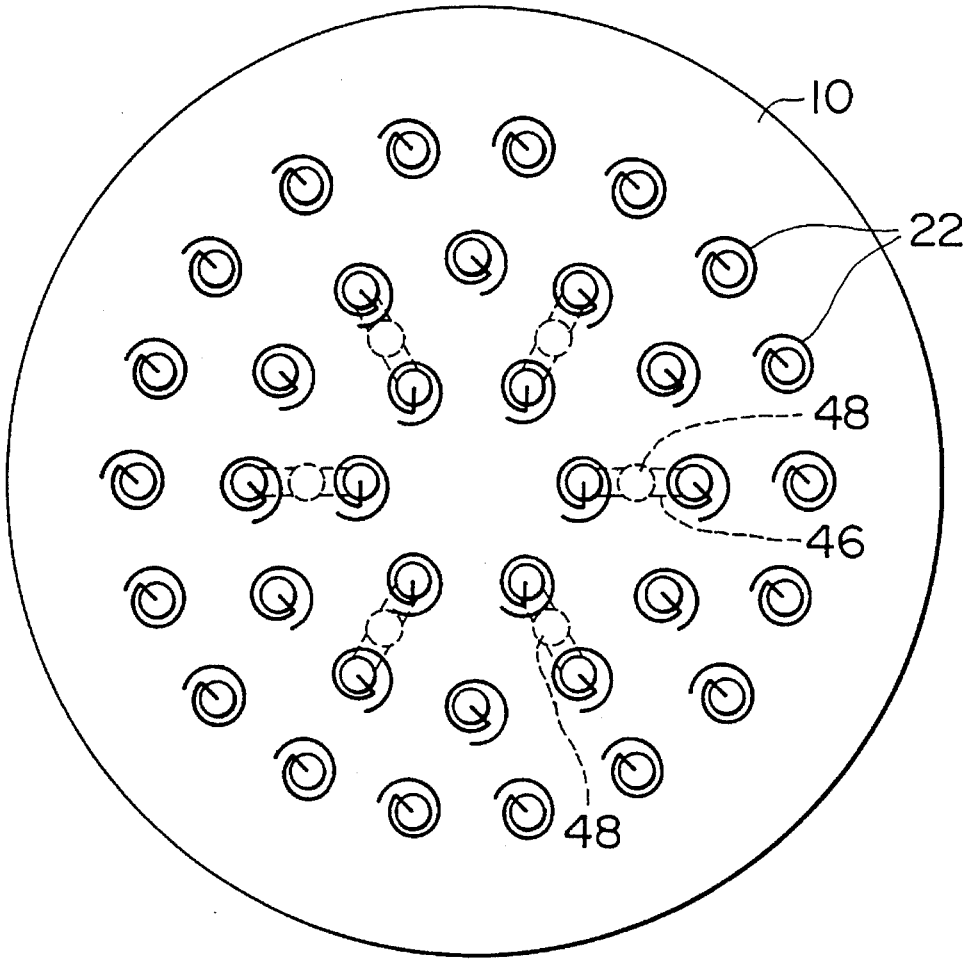
FIG. 20 is a plan view showing the circularly-polarized-wave flat antenna of FIG. 19.

As shown in FIG. 19, according to this embodiment, insulators 18 are formed in a large number of holes in the metal plate of the waveguide by an outsert forming process. In a through-hole for the insulator 18, a shaft portion **22*a* of a curl antenna element 22 is inserted. At the center of a lower metal plate 12, a power feeding member 14** is disposed.

Two adjacent insulators are connected by a connection member 46 disposed below the metal plate 10. Below the center portion of the connection member 46, a brace member 48 extending between the two metal plates 10 and 12 is provided integrally with the connection member 46. As shown in FIG. 20, the number of the connection members 46 and that of the brace members 48 are, for example, six. These connection members 46 and the brace members 48 are radially and circumferentially equidistantly disposed and integrally formed along with the insulators 18.

The inside of the waveguide constructed of the two metal plates 10 and 12 is airtight, thereby preventing moisture from condensing on the inner wall of the waveguide.

Since the brace member 48 is disposed and connected between the two metal plates 10 and 12, even if an outer force is applied to the metal plate 10 and associated members or even if a temperature change results in a force which causes the metal plate 10 to inwardly dent, the brace member 48 prevents the metal plate 10 from being deformed. Thus, even if the metal plates 10 and 12 are thin, they are not deformed and thereby the characteristics of the waveguide do not vary. In addition, since the rigidity of the waveguide becomes large, the metal plates 10 and 12 can be thinly formed. Thus, the entire weight of the circularly-polarized-wave antenna can be reduced.

In addition, the brace member 48 is integrally formed along with the insulator 18 and so forth by the outsert forming process. Thus, the step for placing the brace member 48 is not necessary, so that the number of constructional parts of the antenna is not increased.

It should be noted that the brace member 48 can be formed by other than the outsert forming process. Rather, the brace member 48 may be assembled so that it is held between the two metal plates 10 and 12. In this case, unless these metal plates 10 and 12 are not shortcircuited, the material of the brace member may be a metal. In addition, the shape of the brace member 48 is not limited to a columnar shape, but a variety of shapes such as a plate shape.

As described above, since the brace member prevents the two metal plates from being deformed, the distance therebetween does not vary. Thus, the characteristics of the waveguide can be maintained by a simple construction. In addition, since the metal plates are thin, the entire weight of the circularly-polarized-wave antenna can be reduced.

Moreover, when the inside of the waveguide is airtight, since a temperature change causes the inner pressure to become lower than the atmospheric pressure, a force which causes the metal plates to inwardly dent acts. However, the brace member can stand against this force.

Furthermore, when the brace member is integrally formed along with the insulator and so forth by the outsert forming process, the work for placing the brace member can be omitted. Thus, the number of constructional parts of the antenna is not increased.

Next, with reference to FIGS. 21 and 22, a circularly-polarized-wave flat antenna in accordance with a fifth embodiment of the present invention will be described.

Microwaves received by a circularly-polarized-wave flat antenna are frequency-converted by a converter and then sent to a receiver through a power feeding probe disposed at the center of a hollowed disc-shaped waveguide. Signals from a transmitter are frequency-converted by a converter. Thereafter, the resultant signals are sent from the probe to the hollowed disc-shaped waveguide. Thus, curl antenna elements are excited and thereby circularly polarized microwaves are radiated. Conventionally, the converter is disposed at a predetermined position outside the circularly-polarized-wave flat antenna. The input/output signals of the converter are received/sent from/to the hollowed disc-shaped waveguide through an adequate square waveguide.

As described above, since the input/output signals of the converter are received/sent from/to the probe of the hollowed disc-shaped waveguide through the square waveguide, whenever the electromagnetic wave mode is converted, signals are attenuated. Thus, the gain of the entire equipment decreases. In addition, since the square waveguide for transmission is used, the construction of the equipment becomes complicated and heavy. Moreover, since the construction of the equipment is complicated, moisture easily enters the hollowed disc-shaped waveguide and the square waveguide. Thus, condensation or the like takes place, thereby varying the frequency characteristics.

Figure 21:
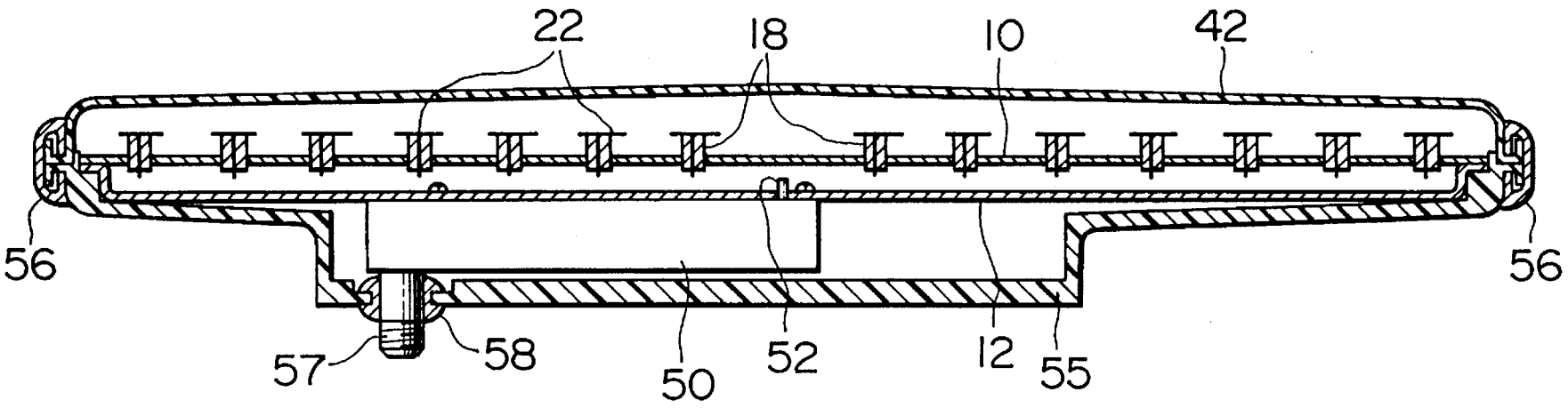
FIG. 21 is a sectional view showing a circularly-polarized-wave flat antenna in accordance with a fifth embodiment of the present invention.
Figure 22:
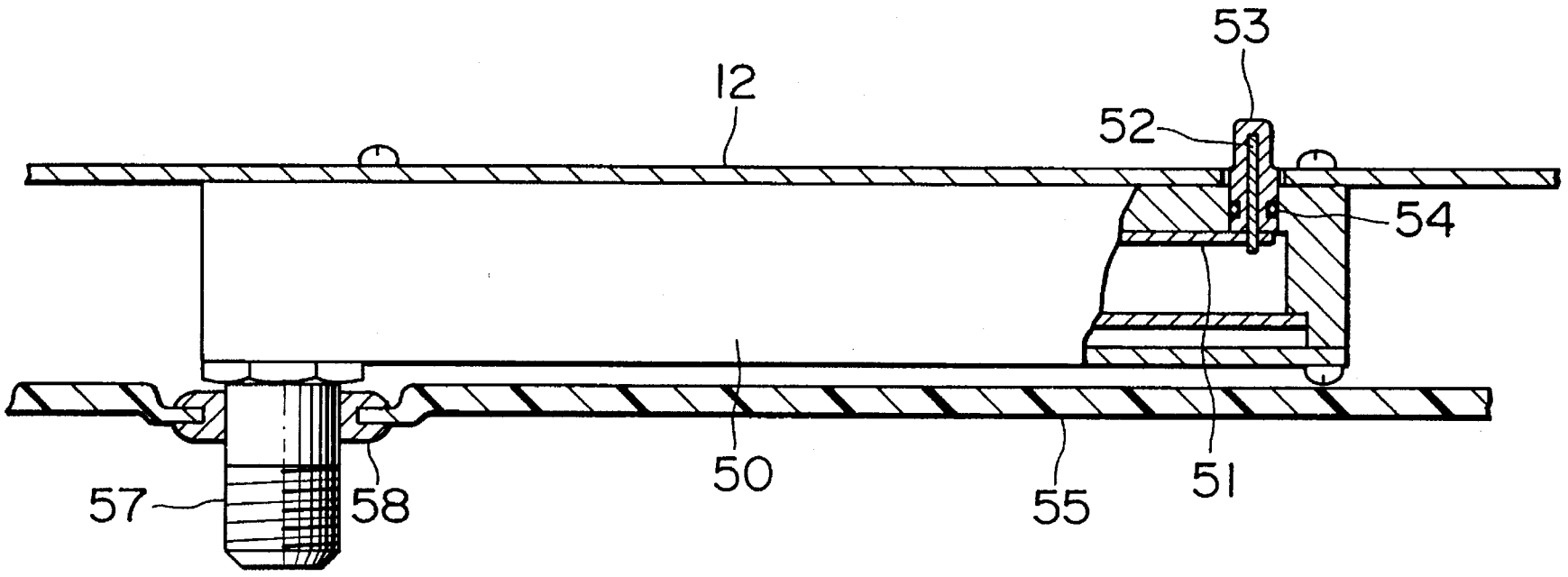
FIG. 22 is a sectional view showing a converter, a housing container thereof, and so forth of the circularly-polarized-wave flat antenna of FIG. 21.

As shown in FIG. 21, outside a metal plate 12 constructing a hollowed disc-shaped waveguide, a housing 50 is provided. As shown in FIG. 22, in the housing 50, a converter comprising a micro-strip-line 51 is accommodated. From the micro-strip-line 51, a probe 52 extends to the outside of the housing 50. The probe 52 extends through the metal plate 12, where the probe 52 is insulated from the metal plate 12. In addition, the probe 52 extends into the hollowed disc-shaped waveguide. Thus, the probe 52 constructs a power feeding probe. Moreover, this probe 52 is watertightly covered by a cap 53 which is made of an insulating resin. The cap 53 and the housing 50 are water-sealed by an O ring 54.

In addition, the housing 50 and an outer surface of the metal plate 12 are covered by a case member 55. The case member 55 is made of a resin. Outside the metal plate 10, a radome 42 for covering curl antenna elements is disposed. The circumference of the radome 42 and that of the case member 55 are watertightly connected by a mole 56. A connector 57 protrudes from the rear surface of the housing 50 and outwardly extends through the case member 55. The connector 57 and the case member 55 are water-sealed by a rubber bush 58.

As described above, since the probe 52 protrudes into the hollowed disc-shaped waveguide as an input/output terminal of the converter, the square waveguide for transmission can be omitted. Thus, the number of times electromagnetic wave mode is converted decreases. As a result, a high gain can be correspondingly obtained. In addition, since the square waveguide for transmission can be omitted, the construction of the equipment is simplified and the weight is reduced.

Moreover, since the housing 50 and the outer surface of the metal plate 12 are covered by the case member 55 which is made of a resin, the connection surface between the housing 50 and the metal plate 12 is free of moisture and so forth. Thus, moisture does not enter the inside of the waveguide from the hole of the metal plate 12 passing through the probe 52. In addition, the probe 52 is covered by the cap 53, even if condensation takes place in the hollowed disc-shaped waveguide, an electric shortcircuit does not occur between the probe 52 and the metal plate 12. Moreover, since the cap 53 and the housing 50 are water-sealed by the O ring 54, moisture does not enter the inside of the housing 50. Thus, the characteristics of the converter does not vary.

Next, with reference to FIGS. 23 to 26, a circularly-polarized-wave flat antenna in accordance with a sixth embodiment of the present invention will be described.

Figure 23:
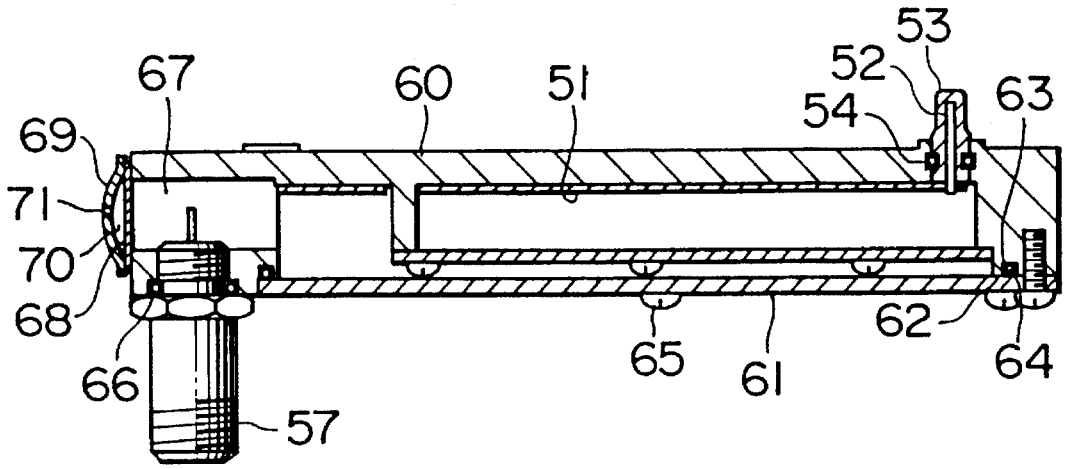
FIG. 23 is a sectional view of the housing container of the converter of the circularly-polarized-wave flat antenna in accordance with the fifth embodiment of the present invention.
Figure 24:
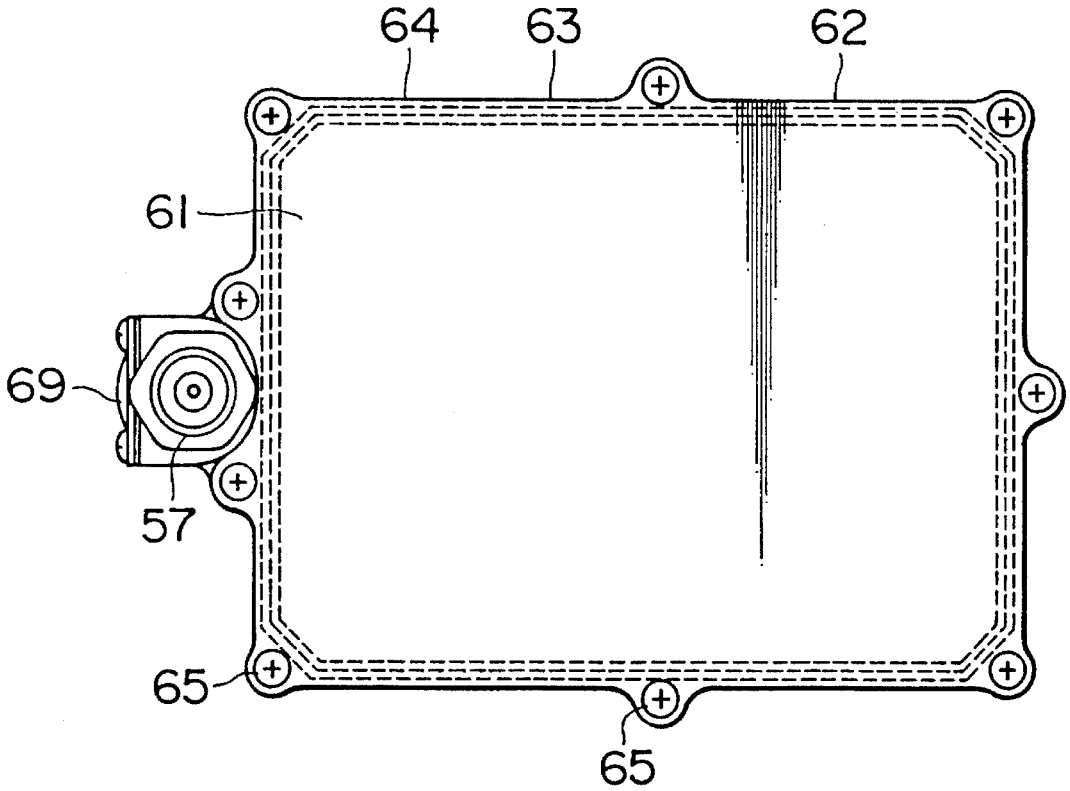
FIG. 24 is a bottom view showing the housing container of FIG. 23.
Figure 25:
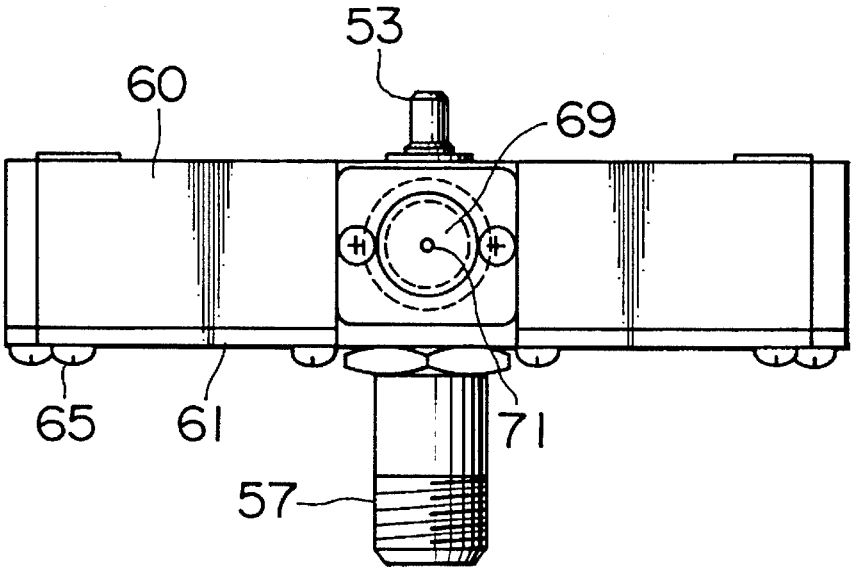
FIG. 25 is a side view showing the housing container of FIG. 23.

As shown in FIG. 23, a converter constructed of a micro-strip-line and so forth is housed in a metal housing member 60. The housing member 60 is closed by a metal cover 61. On the connection surface 62 between the housing member 60 and the cover 61, a groove 63 is circumferentially formed. In this groove 63, a packing 64 is inserted. The housing member 60 and the cover 61 are airtightly connected by machine screws 65. Thus, a housing container is constructed.

A probe 52 which operates as an input/output terminal of a converter protrudes through the housing member 60. This probe 52 is watertightly covered by a cap 53. The cap 53 is made of an insulating resin. Between the cap 53 and the housing 50, an O ring 54 is watertightly disposed. A connector 57 of the converter protrudes through a hole of the housing member 60. On the outer circumference of the connector 57, an O ring 66 is airtightly disposed.

Figure 26:
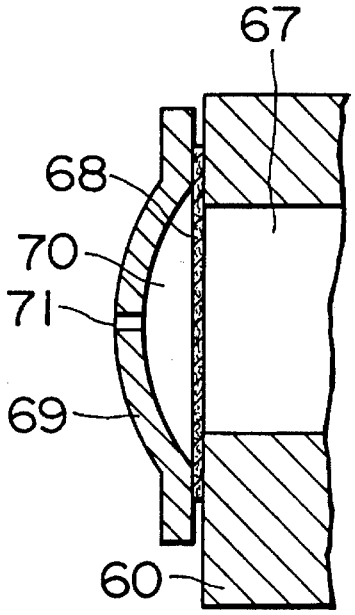
FIG. 26 is an enlarged sectional view of an air penetration film and an air ventilation cover of FIG. 23.

As shown in FIG. 26, on the wall of the housing member 60, an air hole 67 connecting the inside of the housing to the outside is formed. The outer surface of the air hole 67 is closed by an air penetration film 68. The air penetration film 68 has a large number of minute holes whose diameter is smaller than that of water molecules and larger than that of air molecules. The outside of the air penetration film 68 is covered by an air ventilation cover 69. The air ventilation cover 69 has an outwardly convex surface. Thus, an air chamber 70 is formed between the air penetration film 68 and the air ventilation cover 69. The air ventilation cover 69 has small through-holes 71 for connecting the air chamber 70 and the outside (the diameter of each small through-hole 71 is for example 0.8 mm).

As described above, even if air in the housing container expands or contracts according to a temperature change, air can enter and exit through the air penetration film 68. Thus, the change of pressure which acts on the wall of the container due to expansion or contraction of air decreases, and the rigidity of the housing container can be reduced in comparison with that of the related art. Therefore, the wall of the housing container can be thinly formed. In addition, ribs and so forth for reinforcement can be omitted. Moreover, the housing container can be small in size and light in weight. At this point, the air penetration film 68 prevents moisture from entering the inside of the housing container. Thus, condensation does not take place in the inside of the housing container. As a result, the electrical characteristics of the antenna can be stabilized.

Since the air penetration film 68 is covered by the air ventilation cover 69, it is not damaged by an outer force. In addition, since the area of the air penetration film 68 is large, the inside of the housing container can be effectively ventilated through the air chamber 70 and small through-holes 71.

The air penetration film 68 is made, for example, by sticking polyester-textured clothes and performing water-repellent treatment therefor. However, it should be noted that the air penetration film 68 is not limited to it. Rather, any material which can penetrate air and prevent moisture from penetrating may be used for the air penetration film 68. In addition, the probe 52 need not necessarily be covered by the cap 53. Differently put, the requirement is that the probe 52 should be airtight against the housing member 60.

Moreover, it should be noted that the present invention is not limited to each of the above-mentioned six embodiments. For example, the waveguide power distributor is not limited to the hollowed disc-shaped waveguide according to the embodiments. Rather, the waveguide power distributor can be a square waveguide which propagates microwave signals. According to the embodiments, the first metal plate 12 constructing the hollowed disc-shaped waveguide is a shortcircuit plate whose outer circumference is bent. Instead, the shortcircuit plate may be constructed of another member. The metal plates 10 and 12 may be a metal-coated thin film where a metal is deposited or plated on a resin member. The curl antenna elements 22 are not limited to those in accordance with the embodiments. Instead of these curl antenna elements 22, any construction where circularly-polarized-wave antenna elements are each constructed of a shaft portion and a helical portion connected to the top end thereof may be used.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A circularly-polarized-wave flat antenna, comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction.

2. The circularly-polarized-wave flat antenna as set forth in claim 1, further comprising:

a second insulator mounted in a second of the plurality of holes of said metal plate in a position adjacent to the first insulator, and a common connection member formed integrally with the first and second insulators for connecting said insulators.

3. The circularly-polarized-wave flat antenna as set forth in claim 1, wherein said waveguide comprises:

a second metal plate opposed to said first metal plate; and a brace member disposed between said first and second metal plates, for preventing the distance between said first and second metal plates from becoming shorter than a predetermined distance.

4. The circularly-polarized-wave flat antenna as set forth in claim 3, wherein said first and second metal plates form an airtight structure.

5. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

wherein said shaft portion of said circularly-polarized-wave antenna element has bumps formed at a middle thereof, said through-hole of said insulator having an enlarged-diameter portion and a reduced-diameter portion, said enlarged-diameter portion being disposed within the waveguide, said reduced-diameter portion being disposed on an outside thereof, an inner diameter of said reduced-diameter portion being larger than an outer diameter of said shaft portion so that the insertion of said shaft portion into said through-hole causes said through-hole to be resiliently deformed and thereby allowing said bumps to pass through said reduced-diameter portion, the inner diameter of said enlarged-diameter portion being larger than the outer diameter of said shaft portion and said bumps.

6. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

wherein said shaft portion of said circularly-polarized-wave antenna element has a bent portion formed at a middle thereof, said through-hole of said insulator having an enlarged-diameter portion and a reduced-diameter portion, said enlarged-diameter portion being disposed within the waveguide, said reduced-diameter portion being disposed on an outside thereof, an inner diameter of said reduced-diameter portion being larger than an outer diameter of said shaft portion so that the insertion of said shaft portion into said through-hole causes said through-hole to be resiliently deformed and thereby allowing said bent portion to pass through said reduced-diameter portion, an inner diameter of said enlarged-diameter portion being larger than the outer diameter of said shaft portion and said bent portion.

7. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

wherein said shaft portion of said circularly-polarized-wave antenna element has a groove circumferentially formed at the middle thereof, said through-hole of said insulator having an inward protrusion, said protrusion being resiliently deformed so as to allow said shaft portion to pass through said through-hole when said shaft portion is inserted into said through-hole, said inward protrusion being engaged with said groove so as to prevent said shaft portion from slipping out of said through-hole when a force for removing said shaft portion is applied.

8. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said Waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

a protection plate disposed on an outer surface of said metal plate, having holes for encasing circularly-polarized-wave antenna elements; and a radome being a thin plate and disposed on an outer surface of said protection plate.

9. The circularly-polarized-wave flat antenna as set forth in claim 8, wherein said protection plate is formed of a polystyrene plastic.

10. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction; and a radome disposed on an outer surface of said metal plate, having bottomed holes for encasing circularly-polarized-wave antenna elements.

11. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

wherein said waveguide comprises:

a second metal plate opposed to said first metal plate; and a brace member disposed between said first and second metal plates, for preventing the distance between said first and second metal plates from becoming shorter than a predetermined distance; and wherein said insulator and said brace member are integrally formed.

12. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

wherein said waveguide has a second metal plate opposed to said first metal plate, said circularly-polarized-wave antenna further comprising:

a housing disposed outside said second metal plate; and a converter housed in said housing, wherein said converter has a probe as an input/output terminal, said probe protruding from said housing, said probe extending through said second metal plate and protruding in said waveguide, said probe being insulated from said second metal plate.

13. The circularly-polarized-wave flat antenna as set forth in claim 12, wherein said housing and an outer surface of said second metal plate are covered by a case member.

14. The circularly-polarized-wave flat antenna as set forth in claim 12, wherein said probe is covered by an insulating resin, and said housing has a watertight structure.

15. The plane circularly-polarized-wave antenna as set forth in claim 12, wherein said housing comprises a plurality of parts having and being connected to each other via connection surfaces, and wherein said antenna further comprises:

a packing for connecting said connection surfaces of said housing;

a seal member for keeping airtight said input/output terminal of said converter protruding from said housing; and an air penetration film having a plurality of holes whose diameter is smaller than the diameter of water molecules and larger than the diameter of air molecules, for closing air holes defined on a wall of said housing.

16. A circularly-polarized-wave flat antenna as set forth in claim 15, wherein said housing has an air ventilation cover for covering said air penetration film from the outside of said air penetration film and for forming an air chamber along with said air penetration film, said air ventilation cover having at least one through-hole for connecting said air chamber to the outside of said air chamber.

17. A circularly-polarized-wave flat antenna comprising:

a waveguide having at least a first metal plate, said metal plate having a plurality of holes;

at least a first insulator, said insulator being mounted in a hole of said metal plate and having a through-hole and a protrusion, said through-hole extending from the outside of said waveguide to the inside of said waveguide and having a groove which is open to the outside of said waveguide and which extends in the radial direction of said protrusion; and at least one circularly-polarized-wave antenna element having a shaft portion, an arm portion, and a curl portion, said shaft portion being fitted in said through-hole of said insulator and having a top protruding outward beyond said metal plate, said arm portion protruding from said top of said shaft portion to terminate at an end, said curl portion being disposed on a flat plane perpendicular to said shaft portion, wherein a distance or radius from a center of said curl portion increases in the counterclockwise direction of said curl portion as viewed from the top thereof, and wherein the number of turns of said curl portion is in the range from 1 to 1.5, and said curl portion being connected to said end of the arm .portion, said arm portion being engaged with said radially extending groove of said insulator, whereby if the position of said radially extending groove has been set in accordance with a desired orientation of said curl portion of said circularly-polarized antenna element, the engagement of said arm portion with said radially extending groove will automatically set the orientation of said curl portion in a predetermined direction;

wherein said waveguide has a second metal plate opposed to said first metal plate, said circularly-polarized-wave antenna further comprising:

a housing disposed outside said second metal plate; and a converter housed in said housing, wherein said converter has a probe as an input/output terminal, said probe protruding from said housing, said probe extending through said second metal plate and protruding in said waveguide, said probe being insulated from said second metal plate; and wherein said probe is covered by an insulating resin and said housing has an airtight structure.

* * * * *